US006283315B1

(12) United States Patent
Willim et al.

(10) Patent No.: US 6,283,315 B1
(45) Date of Patent: Sep. 4, 2001

(54) CRANE, PREFERABLY A DERRICK CRANE

(75) Inventors: Hans-Dieter Willim, Ulm-Unterweiler; Uwe Frommelt, Ehingen/Donau, both of (DE)

(73) Assignee: Liebherr-Werk Ehingen GmbH, Ehingen/Donau (DE)

( * ) Notice: Subject to any disclaimer, the term of this patent is extended or adjusted under 35 U.S.C. 154(b) by 0 days.

(21) Appl. No.: 09/393,976

(22) Filed: Sep. 10, 1999

(30) Foreign Application Priority Data

Sep. 11, 1998 (DE) ..... 298 16 385 U

(51) Int. Cl.[7] ..... B66C 23/76
(52) U.S. Cl. ..... 212/196; 212/279
(58) Field of Search ..... 212/196, 197, 212/198, 279

(56) References Cited

U.S. PATENT DOCUMENTS 752,248 * 2/1904 Nickerson ..... 212/198
2,526,613 * 10/1950 Tanguy ..... 212/279
4,204,603 * 5/1980 Ducreuzet ..... 212/196
4,280,627 * 7/1981 Becker ..... 212/198
4,349,115 * 9/1982 Lampson ..... 212/178
4,614,275 * 9/1986 Zenno ..... 212/198
4,711,358 * 12/1987 Konishi ..... 212/178
4,716,729 * 1/1988 Kakeya ..... 212/198
4,995,518 * 2/1991 McGhie ..... 212/178

FOREIGN PATENT DOCUMENTS 0 048 076 * 3/1982 (EP) .

* cited by examiner

*Primary Examiner*—Thomas J. Brahan
(74) *Attorney, Agent, or Firm*—Dilworth & Barrese LLP.

(57) ABSTRACT

The present invention is directed to a crane, preferably a derrick crane, having a traveling chassis (1), a revolving superstructure (2) mounted thereon in rotating fashion and connected with a ballast car (6) by a shaft (3) and on which a boom and a derrick, to which the ballast car (6) is connected, are mounted in luffing manner. The shaft (3) is in the form of a telescoping beam that can be telescoped to a length corresponding to the current load or that is longer than the same.

20 Claims, 9 Drawing Sheets

CRANE, PREFERABLY A DERRICK CRANE

BACKGROUND OF THE INVENTION

The invention refers to a crane, preferably a derrick crane with a traveling chassis, a revolving superstructure mounted thereon that is connected with a ballast car by means of a shaft and on which a boom and a derrick, to which the ballast car is connected, are mounted in a luffing manner.

Cranes of this type are known, wherein the weight of the ballast car and the length of the shaft are, in principle, designed for the highest possible load. If lesser weights need to be lifted with these cranes, the maneuverability of the crane is impaired by the fact that the shaft is of a length that can, for example, prevent the rotation of the crane due to obstacles present.

SUMMARY OF THE INVENTION

The object of the invention therefor is to create a crane of the type described above in which the weight of the ballast car is better adjusted to the load to be lifted and that is easier to maneuver.

According to the invention, this object is solved in that the shaft consists of a telescoping beam that can be telescoped to a length corresponding to any given load or is longer than that.

If, for instance, the load is picked up with a relatively steep boom, the load moment produced by the ballast need also be only correspondingly small so that the load can be picked up with a short travel-out for the ballast car; this is of particular advantage when obstacles are present that make additional travel impossible for the ballast car. If the load travels out further during operation, for example, due to the luffing of the shaft, it can simultaneously be drawn back in during operation of the ballast car, to increase the load moment. Such use can be made of the ballast car if it is supported on the ground by means of its wheels, and even more simply if it is suspended due to the size of the load.

The telescoping beam forming the shaft can always be telescoped far enough that the ballast car produces adequate load moment. Based on the resolution of forces of the ballast car suspended from the derrick by means of a cable, only pressure forces and no torque is exerted, in principle, on the shaft.

A particular advantage of the crane according to the invention is that the lever arm acted upon by the counter-ballast produced by the ballast car, can also be changed during operation so that the load moment can always be adjusted to the suspended load and/or changes in the suspended load.

The beam can be telescoped out and in by hand or automatically by the crane operator. Controls are expediently provided that telescope the beam in and out depending on the load to be lifted or, during operation, according to the load moment of the crane.

According to another embodiment of the invention, provision is made for the wheels of the ballast car to be controllable.

According to a preferred embodiment, provision is made for a control that, depending on each extension position of the beam, aligns the axles of the wheels such that they cut the axis of rotation of the revolving structure. This embodiment ensures that the ballast car also easily rotates with the rotation of the revolving structure even if it is not suspended but rather supported on its wheels on the ground.

Expediently, the supporting frame of the ballast car is carried symmetrically to the transverse mid-plane of two sets of wheels. These wheel sets can be rotated by controllable drives, revolving through 360°. In this manner, the sets of wheels can be quickly and easily rotated into the desired position. When transporting the ballast car, the wheel sets can be rotated into a position in which they are under the chassis frame, parallel to the transverse mid-plane thereof.

According to another embodiment of the invention, provision is made for the supporting frame to have laterally-projecting supports in the mid-plane containing the beam. These supports stabilize the ballast car during its separate transportation on the bed of a transportation vehicle. Furthermore, these supports make it possible to move the shaft to the height of the revolving structure, through the corresponding extension and retraction thereof, so that it is easy to connect it to the revolving structure.

Expediently, the telescoping beam consists of pipes so that it can rotate around its longitudinal axis, if, for example, the path of travel of the chassis of the ballast car and the path of travel of the crane have different lateral inclinations.

To be able to transport the frame separately, it is designed to be connected to both the revolving structure and the ballast car. The couplings can, for example, consist of pin joints.

The invention described can be embodied not only by a ballast car, but also, for example, in a crane with a suspended ballast. The invention therefore refers to a crane, preferably a derrick crane, with a traveling chassis, a revolving superstructure mounted thereon, to which a boom and a derrick, on which a suspended ballast is suspended, are mounted in a luffing manner.

The object posed is solved, according to the invention, with such a crane in that the suspended ballast is support by a telescoping beam counter to the revolving structure.

Expediently, the beam can be extended and retracted by means of a control, preferably an automatic control in accordance with the angle of tilt of the boom.

Cranes of the claimed type are generally equipped with overload protection, where, in accordance with the current load, the permissible travel-out conditions are read off the load-carrying tables stored in the crane controls in ROMs. If automatic control of the travel-out conditions of the ballast car or suspended ballast is provided for the telescoping beam, the travel-out conditions are calculated by the crane controls from the load-carrying tables of the overload protection.

BRIEF DESCRIPTION OF THE DRAWING

Examples of embodiments of the invention are explained in greater detail below, based on the drawings.

DESCRIPTION OF THE PREFERRED EMBODIMENT

Figure 1:
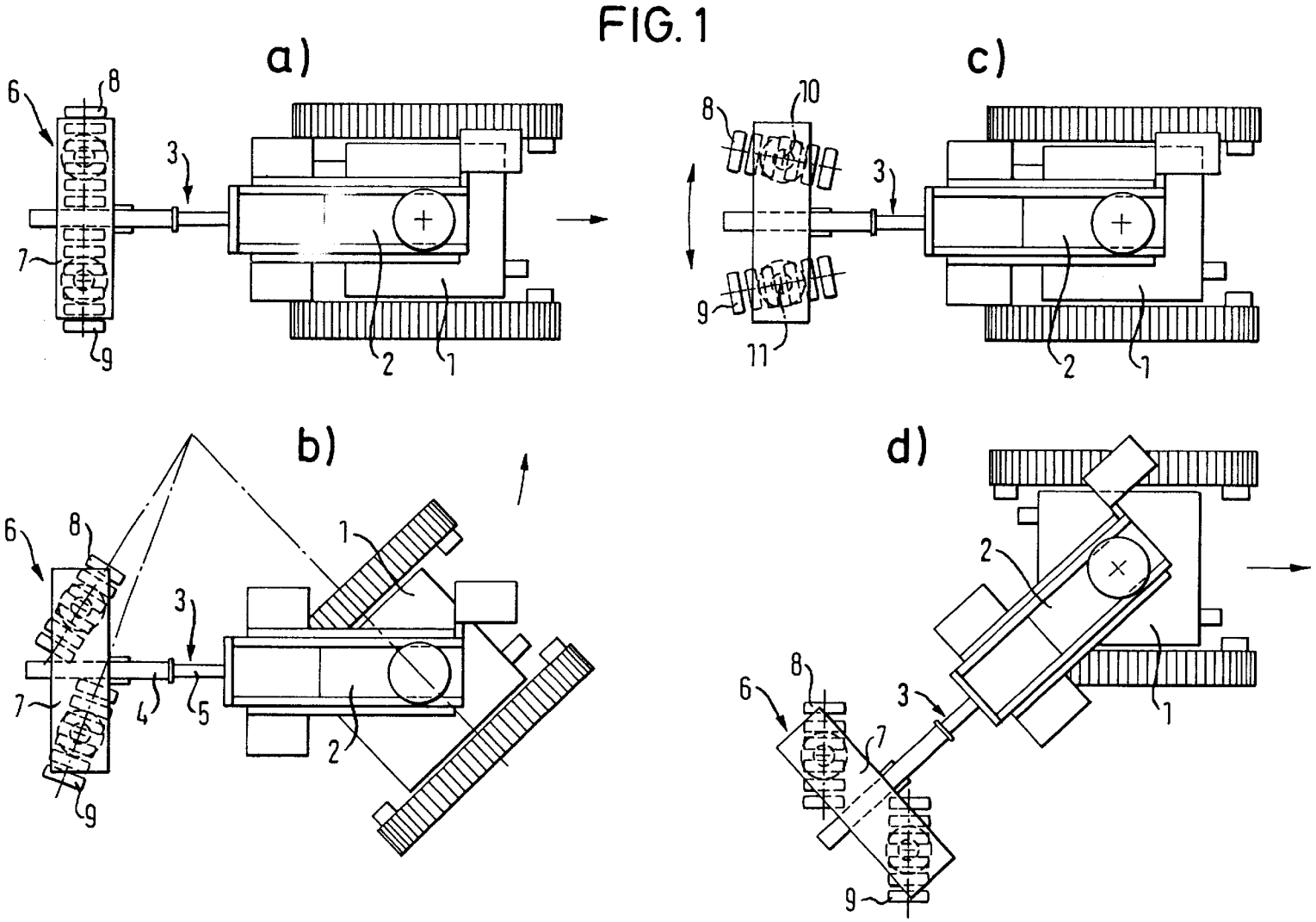
FIGS. 1*a–d* A top view of a derrick crane with a ballast car connected to the revolving structure by means of a telescoping beam, in which the boom and derrick have been omitted for better viewing, FIG. 2 A rear view of the ballast car, FIG. 3 A top view of the ballast car, FIG. 4 A side view of the ballast car according to FIG. 2, FIG. 5 A cross-section through the ballast car without ballast weights with the beam telescoped in, FIG. 6 A ballast car loaded on a transportation vehicle, FIGS. 7*a–e* A side view of derrick cranes with ballast on the ground and suspended ballasts in various widely extended positions in which the boom is omitted, FIG. 8 A side view of the crane according to FIG. 7 with a suspended ballast coupled to the revolving structure by means of a telescoping beam, FIG. 9 A view of the suspended ballast in the direction of arrow X in FIG. 8.
Figure 2:
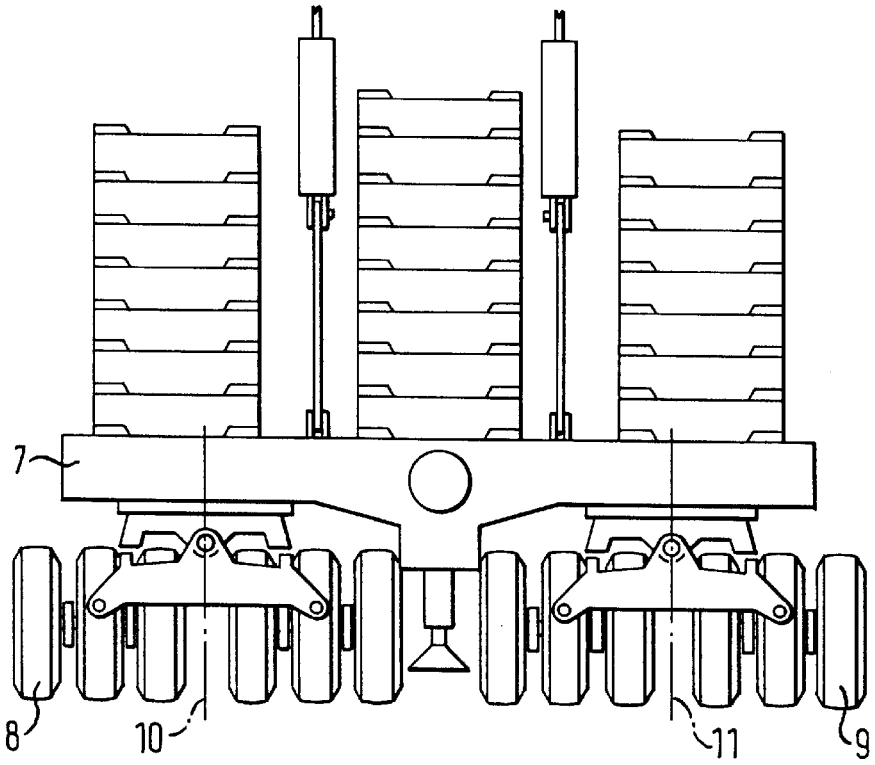

The derrick crane visible in a top view in FIG. 1 without boom and derrick consists of a traveling chassis 1 with two caterpillar tracks and a revolving structure 2 provided with a slewing gear, mounted thereon in a slewable manner, on which structure 2 the boom and derrick (not shown) are mounted in a swiveling manner. The ballast car 6 is coupled to the revolving structure 2 by means of a telescoping beam 3 consisting of lengths of pipe 4 and 5. The ballast car 6 consists of a chassis 7 that has two lateral sets of wheels 8,9, arranged symmetrically to the longitudinal mid-plane in which the telescoping beam 3 lies, with six wheels each, rotating around the vertical axles 10, 11 by means of an endless drive unit. This endless drive unit can consist of a cogwheel and meshing pinion gear powered by a motor, for example a hydraulic motor.

The drives for the wheel sets 8, 9 can be controlled manually by a control device or automatically as well.

FIG. 1*a* shows the position of the wheel sets during straight-forward operation of the crane with a telescoping beam lying in the longitudinal mid-plane.

FIG. 1*b* shows the crane during operation on a curve, in which the wheel sets of the ballast car are also controlled so as to be able to operate in a narrow curve radius.

FIG. 1*c* shows the crane in a position in which the wheel axles cut the axis of rotation of the revolving structure so that the ballast car also can be rotated under load, with the revolving structure.

FIG. 1*d* shows the crane in straight-forward operation with the following ballast car shifted next to the crane.

Figure 3:
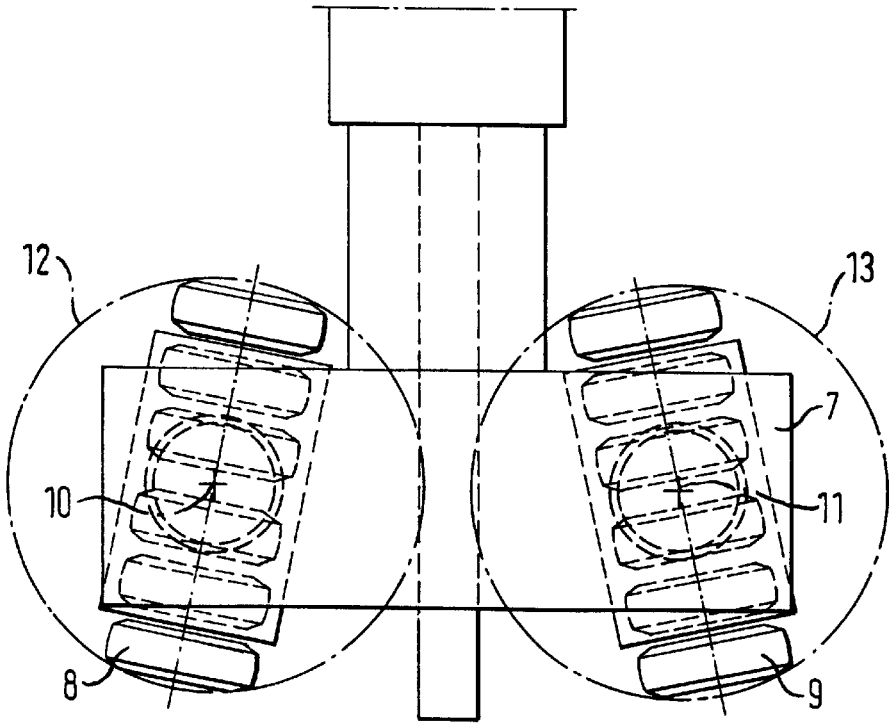

FIG. 3 shows the turning circles 12, 13 of the wheel sets 8, 9.

Figure 4:
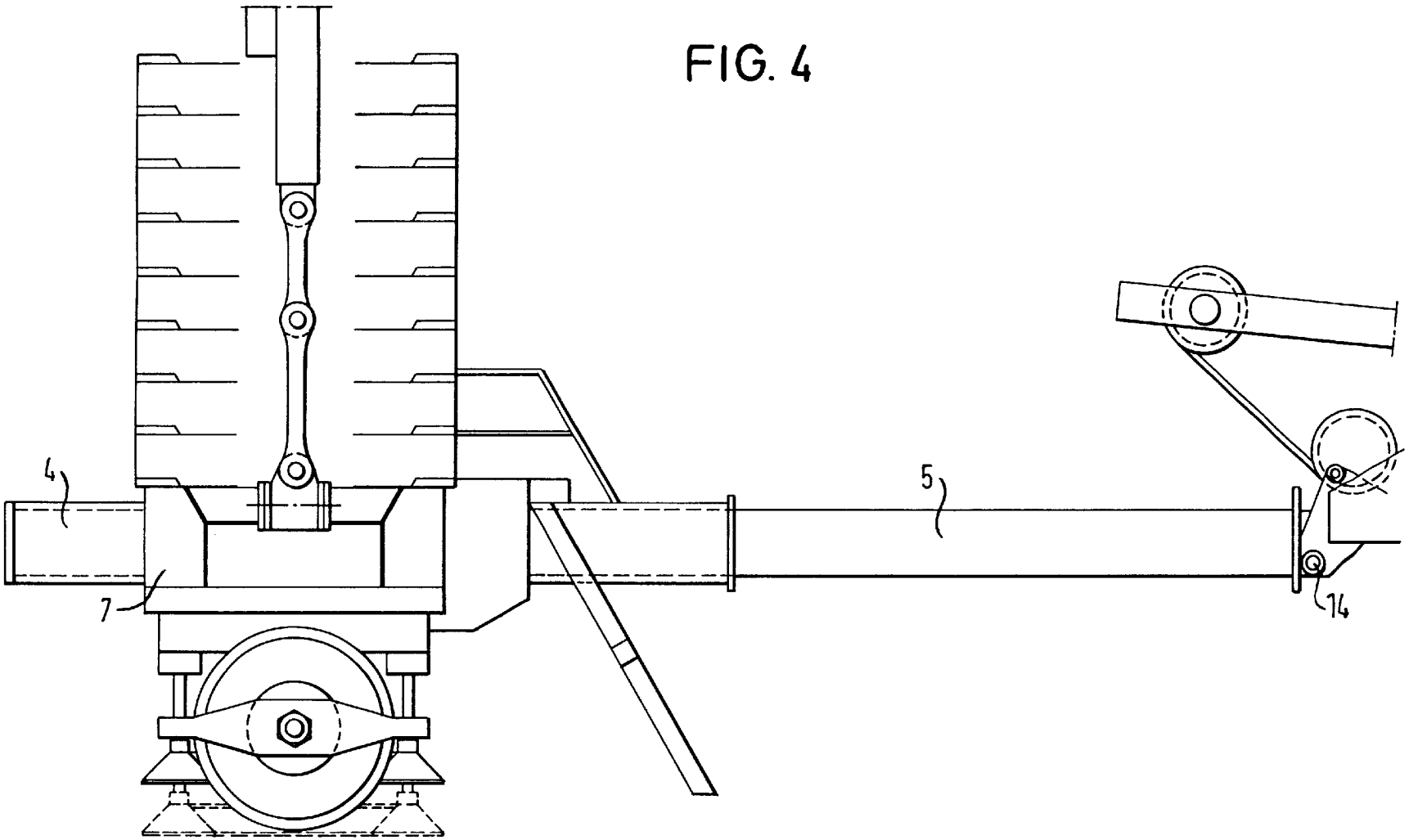

The exterior telescoping pipe 4, as can be seen from FIG. 4, is connected to the chassis 7 of the ballast car The interior telescoping pipe 5 can be connected to the revolving structure 2 by means of a pin joint 14.

Figure 5:
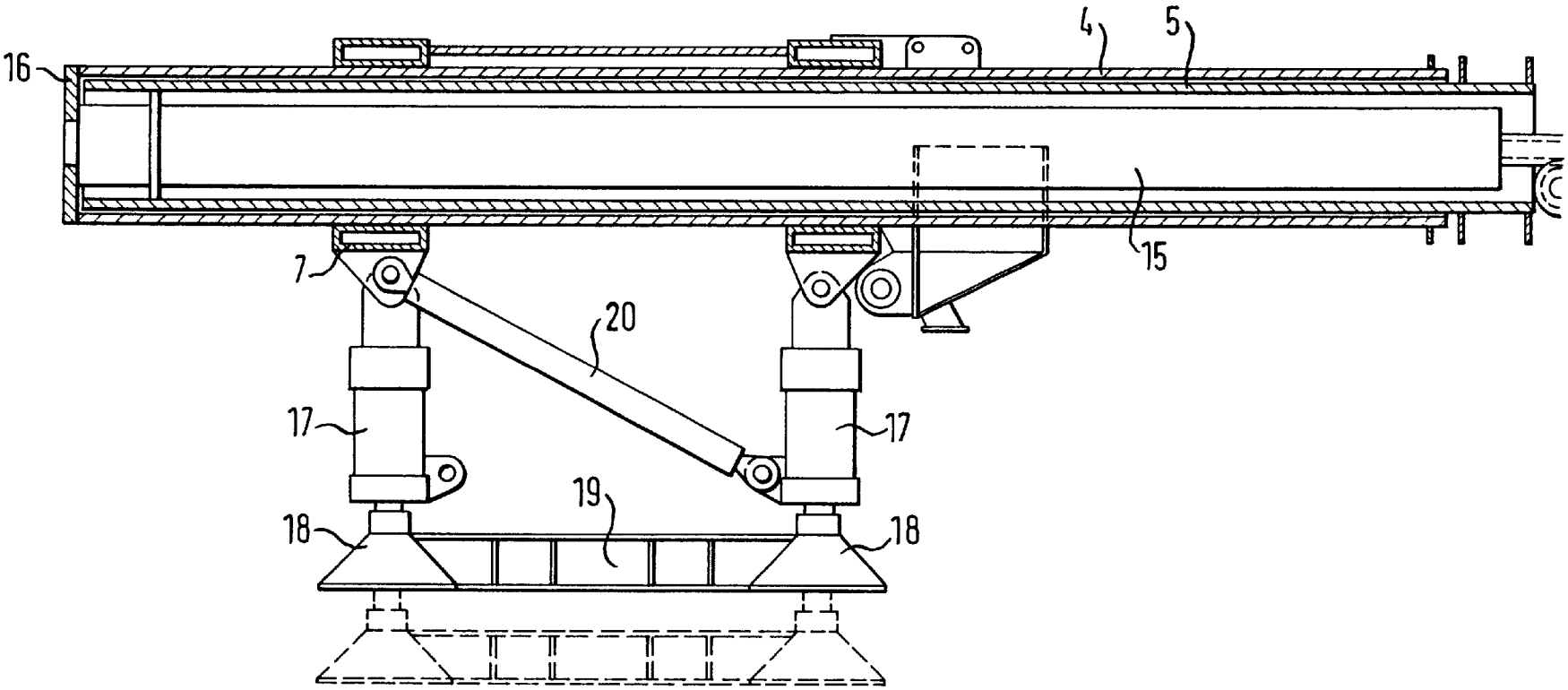

As can be seen from FIG. 5, the interior telescoping pipe 5 is mounted in a movable fashion inside the exterior telescoping pipe 4. The telescoping pipes are moved relative to each other by means of the hydraulic cylinder 15, the cylinder whereof is fixed to a floor plate 16 sealing the exterior telescoping pipe 4.

Two hydraulic piston cylinder units 17 are coupled to the supporting frame 7 of the chassis of the ballast car 6, in the longitudinal mid-plane in which the telescoping beam also lies; the cylinders thereof bear screw jacks 18 which are connected together by means of beam 19. To stabilize the four-bar mechanism, stabilizing bar 20 is provided that is connected in a transverse, articulated manner, as can be seen in FIG. 5, to the joint of the one piston cylinder unit at the supporting frame and to the cylinder of the other piston cylinder unit 17.

Figure 6:
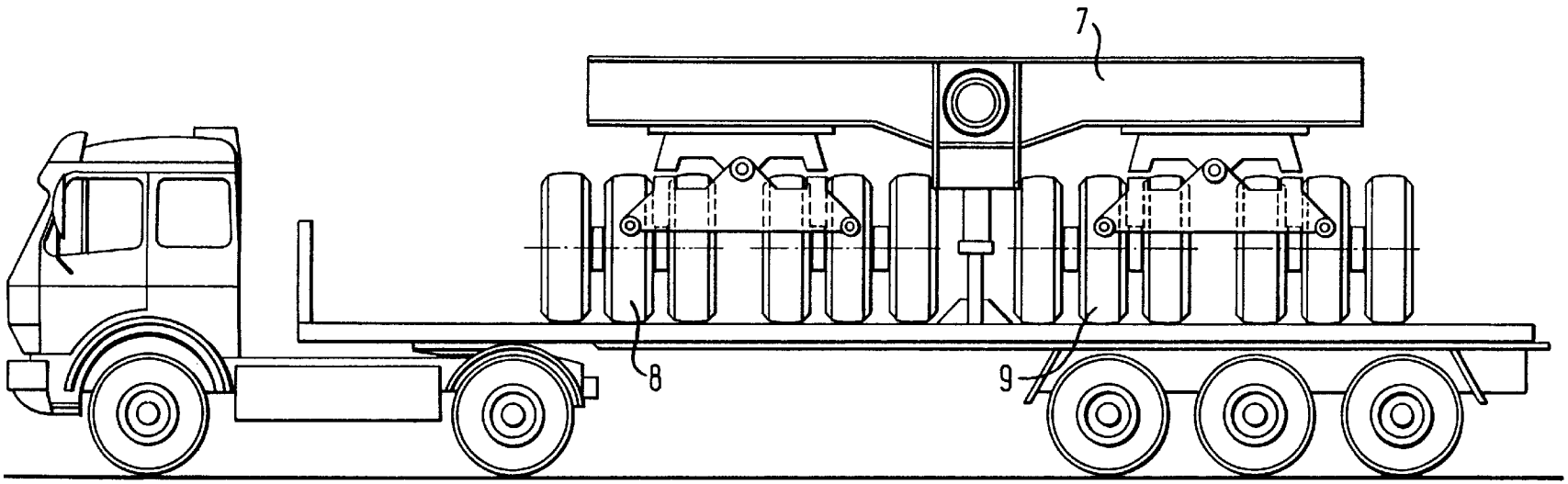

In FIG. 6, in the position with the ballast car loaded on the platform of a semi-trailer truck, the wheel sets 8, 9 are under the supporting frame 7, oriented parallel to the transverse mid-plane thereof.

Figure 7:
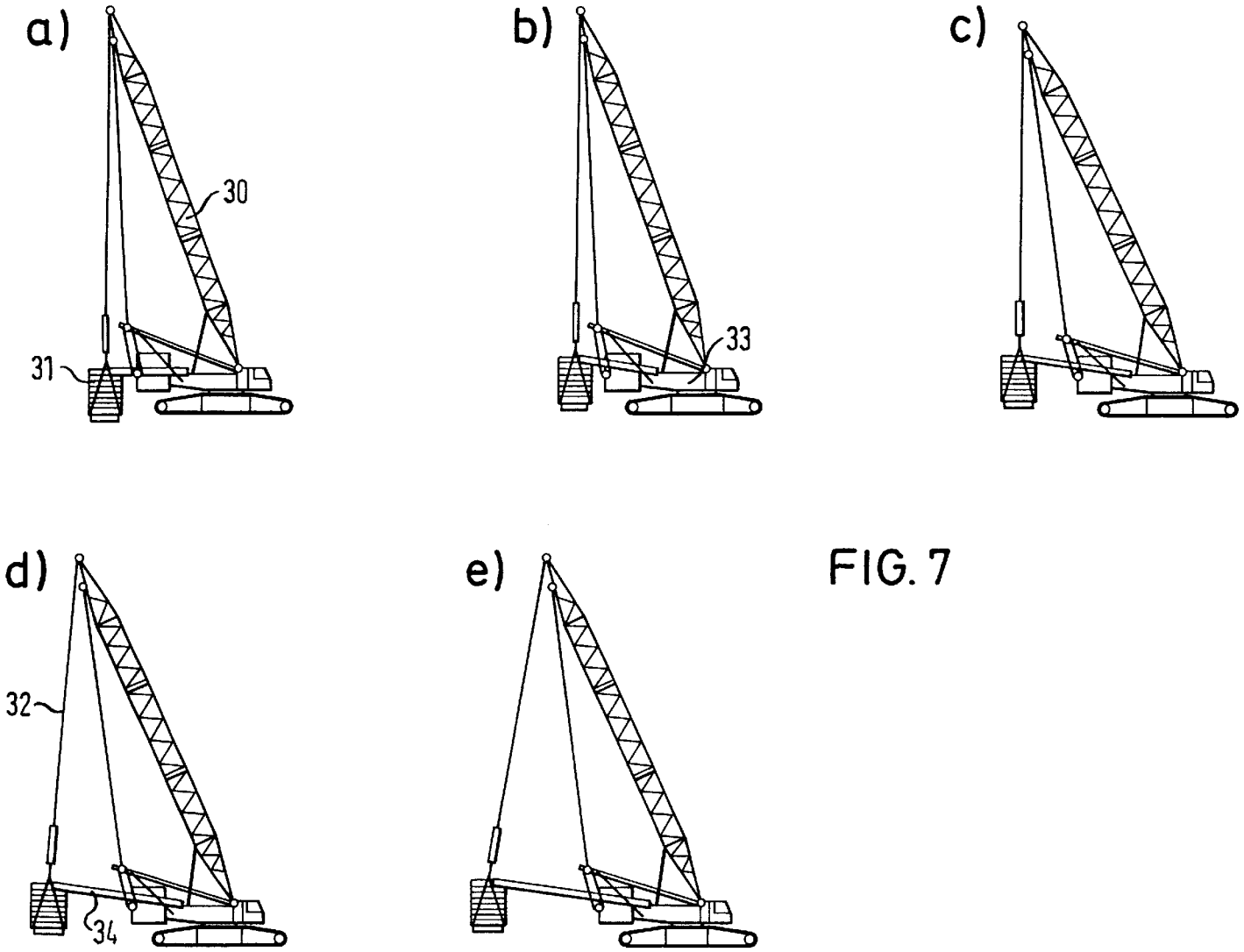

FIG. 7 shows a derrick crane without boom, on the derrick 30 of which, the suspended ballast 31 is hung by means of a cable 32. The traveling chassis and revolving structure are, in principle, designed in the same manner as described in relation to FIG. 1.

Figure 8:
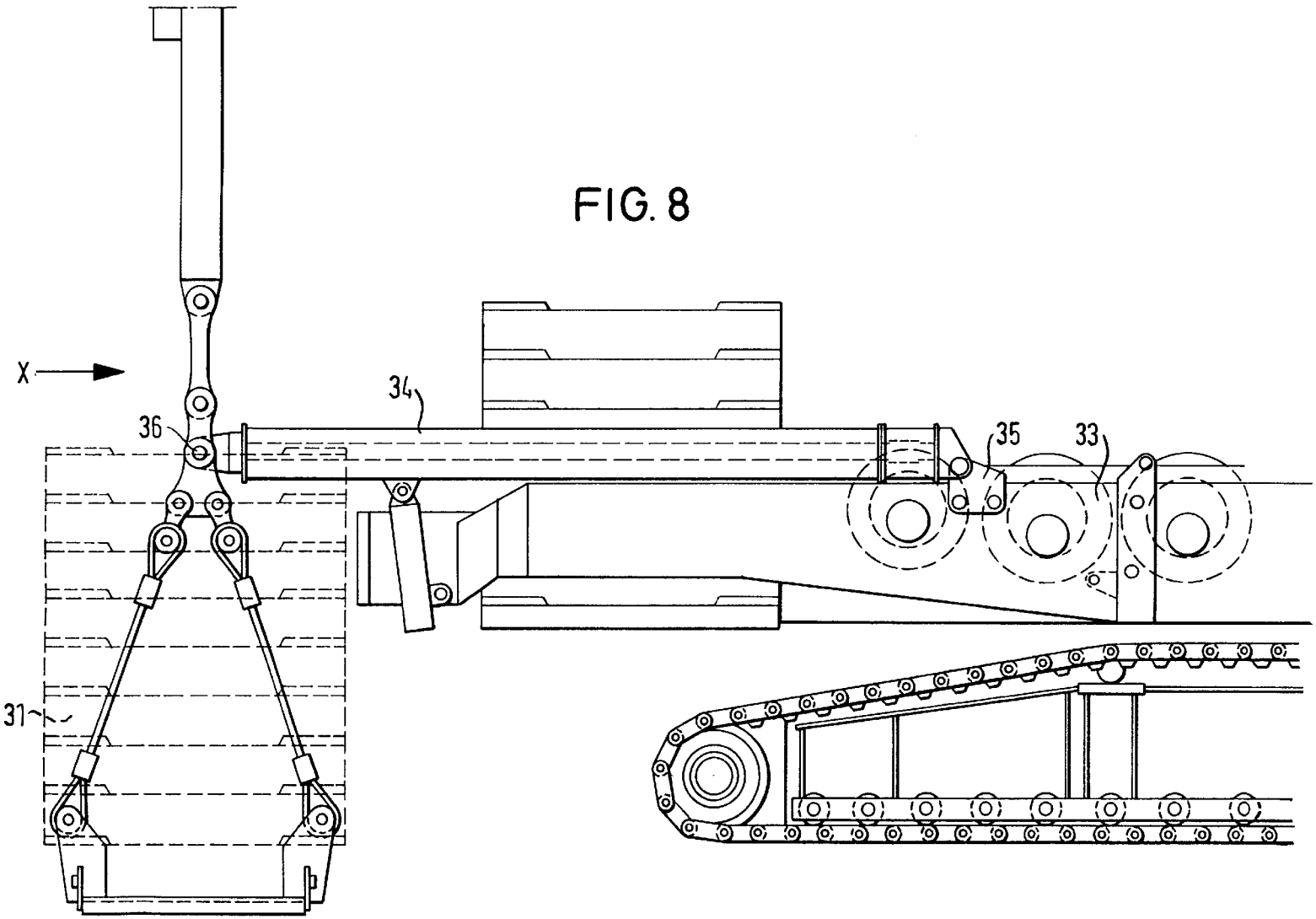
Figure 9:
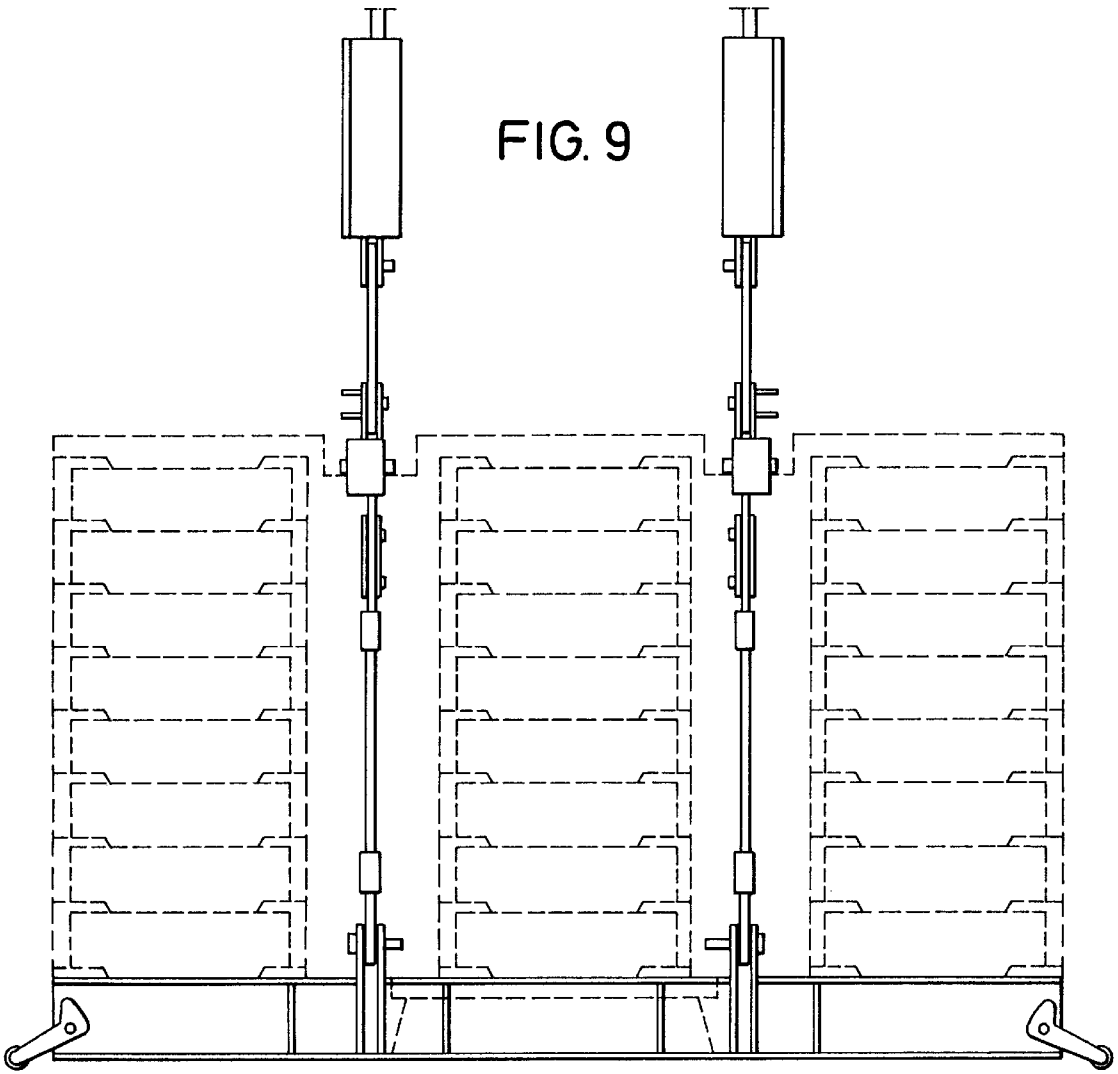
Figure 10:
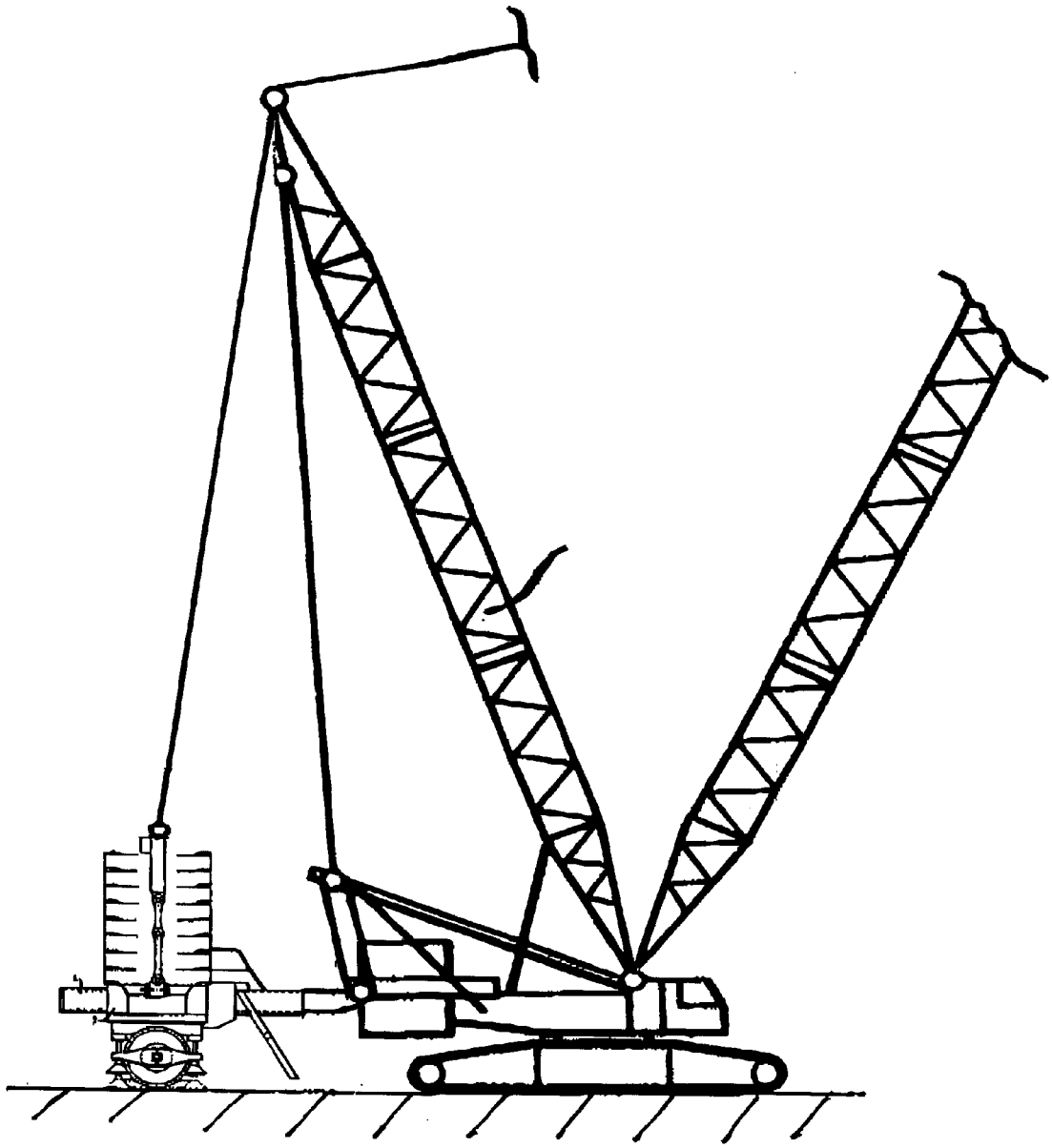
FIG. 10 is a side view similar to FIGS. 4 and 7*a* illustrating the inventive crane with both the derrick and the boom.

The suspended ballast 31 is connected with the revolving structure 33 of the derrick crane by means of a telescoping beam 34. The telescoping beam 34 is connected, in the manner shown in FIG. 8, to the revolving structure 33 by means of a pin joint 35 and to the suspension of the suspended ballast 31, in an articulated manner, by means of the pin joint 36. The telescoping beam 34, as can be seen in FIG. 7, can be telescoped or extended outward in accordance with the current load or in accordance with the current luff angle of the boom (not shown), so that the load moment corresponding to the pivoting angle of the boom can be produced simply by a corresponding telescoping outward of the suspended ballast.

What is claimed is:

1. Crane comprising a traveling chassis (1), a revolving superstructure (2) mounted on the chassis (1) in rotatable fashion, a boom and a derrick (30) each having first and second ends and each being connected to said revolving superstructure (2) at first ends thereof, and a ballast car (6) suspended from a second end of said derrick (30) by a tensional member (32) and additionally directly connected to the revolving superstructure (2) by a shaft (3) separately coupled to said superstructure (2) from said derrick (30), the ballast car (6) together with the tensional member (32) connected thereto, are mounted to be movable towards and away from the revolving superstructure (2) by adjusting length of the shaft (3), wherein the shaft (3) is in the form of at least two pipes (4, 5), one (5) telescoping into the other (4) and structured and arranged to be continuously telescoped even when the crane is operated under load, and means for automatically telescoping said telescoping shaft (3) even when said crane is under load and thereby adjusting length of said shaft (3) corresponding to load acting on the boom, are provided.

2. Crane according to claim 1, wherein said means comprise a control provided to telescope the shaft (3) in or out in accordance with at least one of load to be lifted and, during operation, load moment of the crane.

3. Crane according to claim 2, wherein wheel axles (10,11) of wheel sets (8,9) of the ballast car (6) are structured and arranged to be controlled by the control.

4. Crane according to claim 3, wherein the control is provided to direct the wheel axles in such manner that the axles cut an axis of rotation of the revolving structure (2), in accordance with any given extension state of the beam (3).

5. Crane according to claim 2, wherein a supporting frame (7) of the ballast car (6) is structured and arranged to be carried symmetrically to a mid-plan of two wheel set (8,9).

6. Crane according to claim 2, wherein wheel sets (8,9) are structured and arranged to be rotated around a middle vertical axis thereof by controllable drives.

7. Crane according to claim 2, wherein a supporting frame (7) is provided in a mid-plan thereof with projecting supports (17,18) structured and arranged to be extended and retracted.

8. Crane according to claim 2, wherein the telescoping beam (3) revolves around a longitudinal axis thereof to compensate for varying angles of tilt of pavement.

9. Crane according to claim 1, wherein wheel sets (wheel axles) (8,9) of the ballast car (6) are structured and arranged to be controlled.

10. Crane according to claim 9, wherein a control is provided to direct wheel axles in such manner that the axles cut an axis of rotation of the revolving structure (2), in accordance with any given extension state of the beam (3).

11. Crane according to claim 9, wherein a supporting frame (7) of the ballast car (6) is carried symmetrically to a mid-plane of the two wheel sets (8,9).

12. Crane according to claim 9, wherein the wheel sets (8,9) are structured and arranged to be rotated around a middle vertical axis thereof by controllable drives.

13. Crane according to claim 9, wherein a supporting frame (7) is provided in a mid-plane thereof with laterally-projecting supports (17, 18) structured and arranged to be extended and retracted.

14. Crane according to claim 9, wherein the telescoping beam (3) is structured and arranged to revolve around a longitudinal axis thereof to compensate for varying angles of tilt pavement.

15. Crane according to claim 1, wherein a supporting frame (7) of the ballast car (6) is carried symmetrically to a mid-plane of two wheel sets (8,9).

16. Crane according to claim 1, wherein wheel sets (8,9) are structured and arranged to be rotated around a middle vertical axis thereof by controllable drives.

17. Crane according to claim 1, wherein a supporting frame (7) is provided in a mid-plane thereof with projecting supports (17,18) structured and arranged to be extended and retracted.

18. Crane according to claim 1, wherein the telescoping beam (3) revolves around a longitudinal axis thereof to compensate for varying angles of tilt of pavement.

19. Crane according to claim 18, wherein the beam (34) is structured and arranged to be extended and retracted by a control, in accordance with load moment of the crane.

20. Crane comprising a traveling chassis (1), a revolving structure (2) mounted on the chassis (1) in rotatable manner, a boom and a derrick (30) each having first and second ends and each being connected to said revolving structure (2) at first ends thereof, and a ballast (31) suspended from a second end of the derrick (30) by a tensional member (32) and additionally directly connected to the revolving structure (2) by a shaft (3) separately coupled to said superstructure (2) from said derrick (30), the ballast (31) together with the tensional member (32) attached thereto are structured and arranged to be movable towards and away from the revolving structure (2) by adjusting length of the shaft (3), wherein the shaft (3) is in the form of at least two pipes (4,5), one (5) telescoping into the other (4) and structured and arranged to be continuously telescoped even when the crane is operated under load, and means for automatically telescoping said telescoping shaft (3) even when said crane is under load and thereby adjusting length of said shaft (3) in accordance with a load acting on the boom, are provided.

* * * * *